United States Patent [19]

Simms

[11] 4,258,833

[45] Mar. 31, 1981

[54] PORTABLE LECTERN

[76] Inventor: Charles C. Simms, 5123 Elmwood Dr., San Jose, Calif. 95130

[21] Appl. No.: 99,519

[22] Filed: Dec. 3, 1979

[51] Int. Cl.[3] ..... A45C 9/00

[52] U.S. Cl. ..... 190/11; 248/461; 108/14; 108/41

[58] Field of Search ..... 190/11; 248/461; 108/14, 33, 41

[56] References Cited

U.S. PATENT DOCUMENTS

| | | | |
|---|---|---|---|
| 3,110,375 | 11/1963 | Uggerby | 190/11 |
| 3,177,991 | 4/1965 | Walker | 190/11 |
| 3,424,283 | 1/1969 | Sheldon | 190/11 |

*Primary Examiner*—Donald F. Norton
*Attorney, Agent, or Firm*—John J. Leavitt

[57] ABSTRACT

Presented is a portable lectern which in its closed condition resembles a briefcase and which may be opened to provide a convenient self-supporting lectern for a public speaker.

10 Claims, 11 Drawing Figures

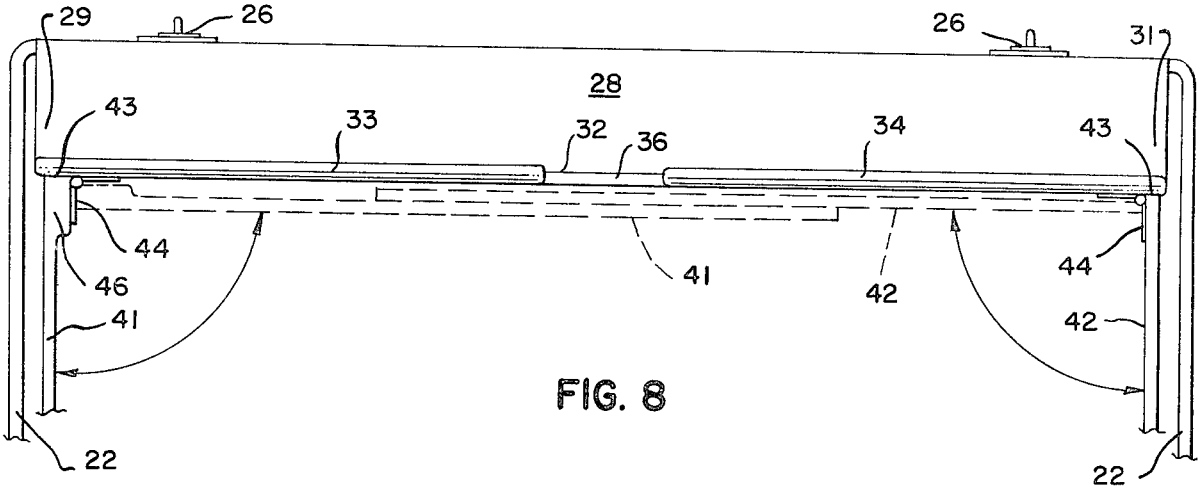
FIG. 8
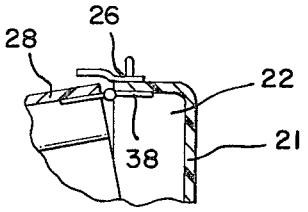
FIG. 9
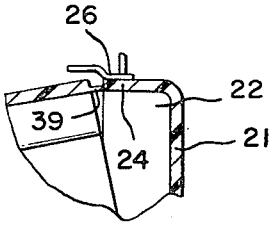
FIG. 12
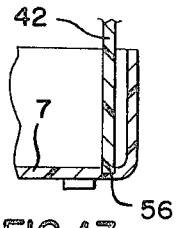
FIG. 13
FIG. 10
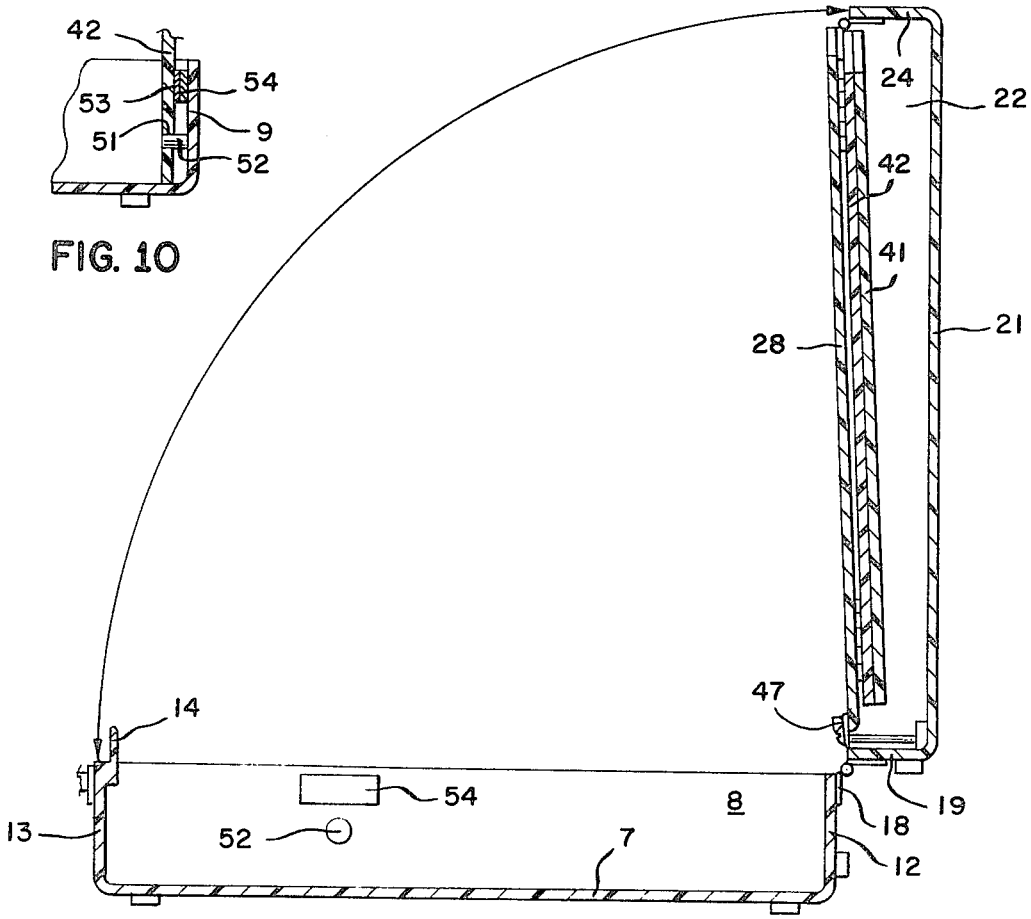
FIG. 11

PORTABLE LECTERN

BACKGROUND OF THE INVENTION

1. Field of the Invention

This invention relates to a portable lectern, and particularly to a portable lectern that is self-contained within its own case, provides adequate storage within the case for papers and paraphernalia, and which may be opened from a closed condition in which the portable lectern resembles a common suitcase or briefcase into a self-supporting lectern for use by a public speaker.

2. Description of the Prior Art

The prior art is replete with lecterns of various types, sizes and constructions, most being portable, but also having disadvantages of one type or another. A search of Class 190, sub-class 11 has revealed the following patents:

| | |
|---|---|
| 2,415,664 | 307,188 |
| 469,342 | 693,973 |
| 2,522,322 | 2,598,128 |

In addition to the above listed patents, other patents as follows have been examined:

| | | |
|---|---|---|
| D 118,484 | D 118,485 | D 210,670 |
| D 215,665 | 3,177,991 | 3,424,283 |
| 3,773,154 | 3,833,098 | 3,110,375 |

Referring to U.S. Pat. No. 307,188 listed above, this patent relates primarily to a desk attachment for trunks and differs significantly in its constructional features from the portable lectern forming the subject matter of this invention. U.S. Pat. No. 469,342 constitutes a travelers case or briefcase within which is mounted a mirror structure, the design and purpose of this invention being significantly different from the subject matter of the portable lectern herein.

U.S. Pat. No. 693,973 relates to a trunk structure that is transformable into a writing desk. Again, the structure of this patent is significantly different from the portable lectern forming the subject matter of this invention.

U.S. Pat. No. 2,415,664 constitutes a portable cash register in that the carrying case is divided into segments interiorly into which money may be deposited. There appears to be only a superficial resemblance between the structure taught by this patent and structure forming the portable lectern herein. It is believed that a sufficient number of significant structural and mode of operation differences exist to support patentability of the present portable lectern.

U.S. Pat. No. 2,522,322 relates to a leg assembly for luggage which supports the luggage either in a horizontal or a vertical attitude. U.S. Pat. No. 2,598,128 is directed specifically to a speaker's folding stand which to some extent performs the same ultimate function performed by the portable lectern forming the subject matter of this invention, but which is so different in its construction as to be irrelevant as prior art.

One of the difficulties that has been encountered in connection with portable lecterns is that the structural features of conventional portable lectern devices discourage or preclude the use of the case for carrying books, papers, pamphlets, speeches or other paraphernalia required by the public speaker during use of the portable lectern. Accordingly, one of the important objects of the invention is the provision of a portable lectern that includes a case for carrying such paraphernalia.

Another difficulty that has been encountered with portable lecterns, and even lecterns of a less portable type, has been the fragile nature of the lectern, its diminutive size, thus precluding the adequate support of speech materials including books, pamphlets and binders, and the relatively complicated steps for opening and closing a given structure to convert it from a closed condition on the one hand to an open and useable portable lectern on the other. Accordingly, a still further object of the invention is the provision of a portable lectern which is simplified in its construction and therefor uncomplicated to open or close, sturdy enough when opened to permit pounding of the fist on the lectern surface, and which provides a surface of sufficient size to retain the usual paraphernalia used by speakers during delivery of a speech.

Another problem that has been encountered with conventional portable lecterns is the tendency for such portable lecterns to collapse during use. Accordingly, another object of the invention is to provide a portable lectern structure in which the supporting elements of the lectern surface are locked in such a manner as to preclude inadvertent collapse of the portable lectern.

The invention possesses other objects and features of advantage, some of which with the foregoing will be apparent from the following description and the drawings. It is to be understood however, that the invention is not limited to the embodiment illustrated and described, since it may be embodied in various forms within the scope of the appended claims.

SUMMARY OF THE INVENTION

In terms of broad inclusion, the portable lectern of the invention comprises lower and upper case portions pivotally hinged together so that when in closed condition they resemble a suitcase or briefcase. A carrying handle and appropriate clasps are provided for carrying the case and for locking the case in a closed condition. Mounted in the upper portion of the case is a top lectern surface or panel to which there is pivotally attached side support members that interengage detachably with the lower case portion to support the top lectern surface or panel in a secure manner, and to enclose the sides of the lectern so that any materials, such as books, pamphlets and paraphernalia, contained within the lower portion of the case are not visible when the portable lectern is in use.

BRIEF DESCRIPTION OF THE DRAWINGS

FIG. 8 is an enlarged fragmentary elevational view of the upper lectern surface as indicated by the line 8—8 in FIG. 3.

FIG. 9 is a fragmentary cross-sectional view taken in the plane indicated by the line 9—9 in FIG. 6.

FIG. 10 is a fragmentary cross-sectional view taken in the plane indicated by the line 10—10 in FIG. 7.

FIG. 11 is an enlarged cross-sectional view illustrating the portable lectern device in open condition but with the lectern elements secured in collapsed or retracted position.

FIG. 12 is a fragmentary cross-sectional view illustrating another embodiment for pivoting an upper lectern surface to a case top.

FIG. 13 is a fragmentary cross-sectional view illustrating another embodiment for retaining the lectern side support members.

DESCRIPTION OF THE PREFERRED EMBODIMENT

Figure 1:
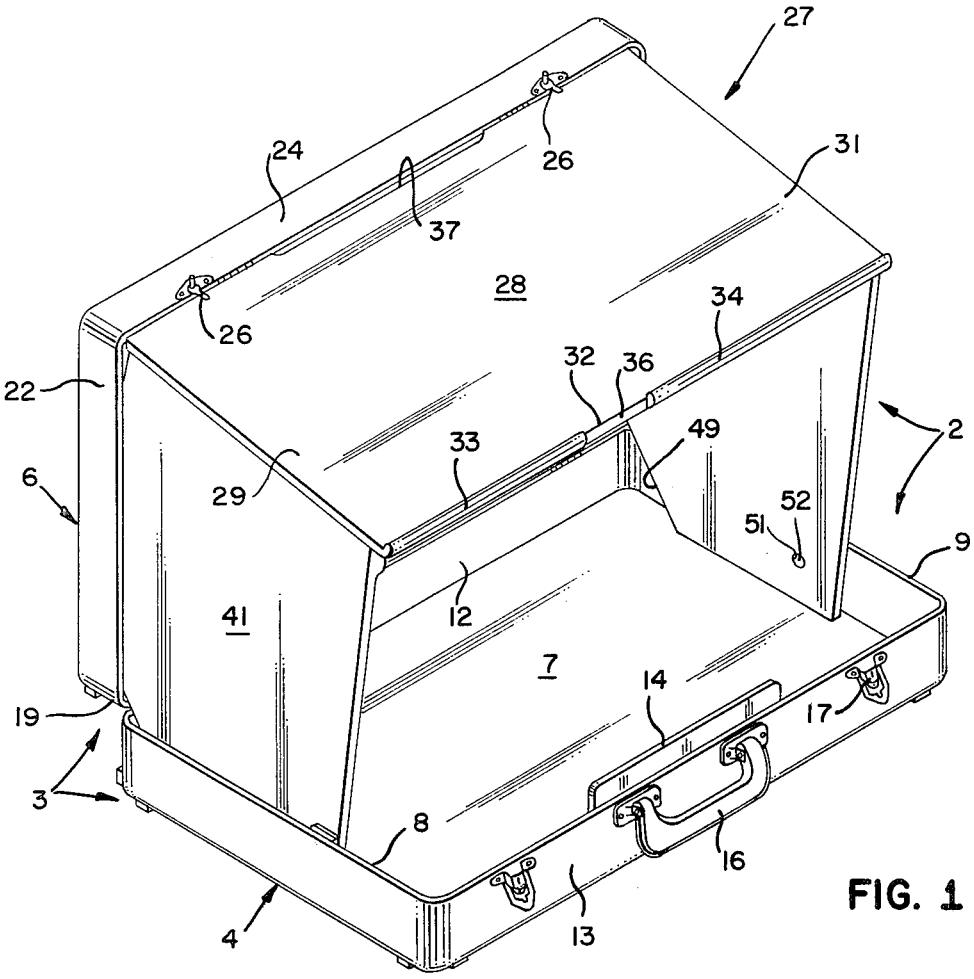
FIG. 1 is a perspective view illustrating the portable lectern device in open condition.

In terms of greater detail, and referring to FIG. 1, it will there be seen that the portable lectern device of the invention is designated generally and in its entirety by the numeral 2, and comprises a suitcase or briefcase portion designated generally by the numeral 3, made up by a lower case portion 4 and an upper case portion 6. The lower case portion 4 is generally configured in the form of a shallow box defined by a bottom 7, end walls 8 and 9, a rear wall 12, and a front wall 13. The front wall 13 may be appropriately reinforced with a reinforcement member which, in the illustration in FIG. 1, is shown to be a flange 14 projecting beyond the top edge of the front wall 13, but which in a finished production version of the case may constitute an integral reinforcement such as a thickening of the front wall in the vicinity of the handle 16. Latch members 17 are provided on the front wall 13 for a purpose which will hereinafter be described.

The lower case portion 4 is pivotally interconnected with the upper case portion 6 by suitable hinges 18 pivotally interposed between the back wall 12 of the lower case portion 4 and the back wall 19 of the upper case portion 6. In addition to the back wall 19, the upper case portion 6 also includes a top wall 21, end walls 22 and 23 and a front wall 24. Like the lower case portion 4, the upper case portion 6 is generally rectangular in its configuration, resembling a shallow box-like structure. The front wall 24 of the upper case portion 6 is adapted to mate with the front wall 13 of the lower case portion and is provided with lock lugs 26 adapted to detachably interengage with the latch member 17 secured on the front wall 13 of the lower case portion 4.

Figure 2:
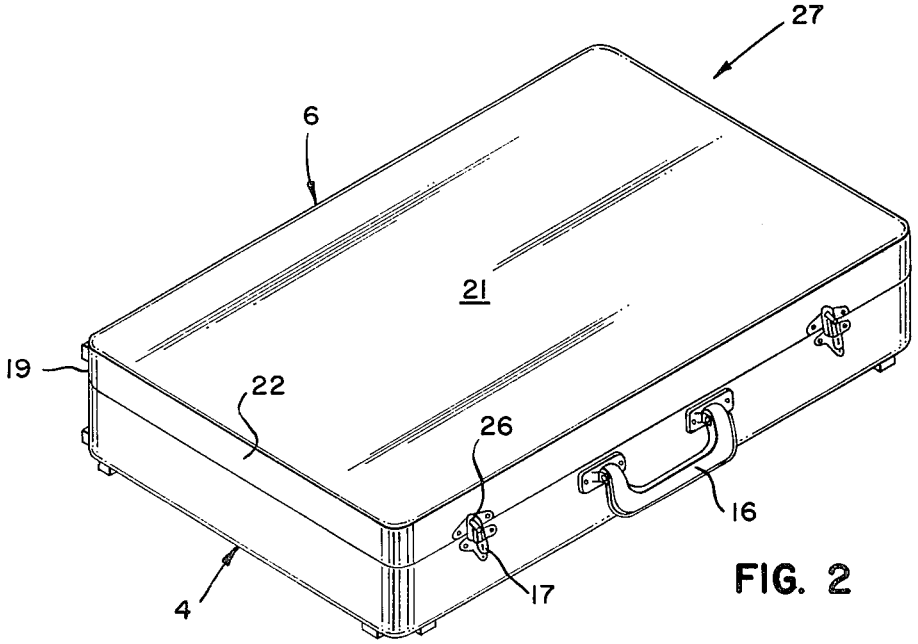
FIG. 2 is a perspective view illustrating the portable lectern device in closed position.
Figure 3:
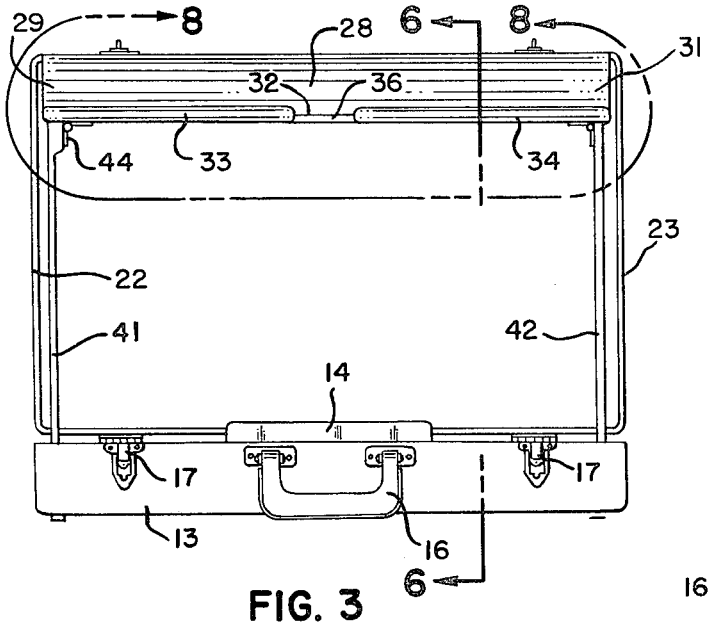
FIG. 3 is a front elevational view of the portable lectern shown in open position.

The case 3 is illustrated in FIG. 2 in closed condition contains all of the elements for supporting interiorly a collapsible lectern structure designated generally by the numeral 27 and comprising a relatively large flat top plate portion 28, generally rectangular in its configuration, and provided with side edge portions 29 and 31, and a front edge portion 32 having lip portions 33 and 34 on opposite sides of a central portion 36 devoid of such a lip portion. The lip portions 33 and 34 provide a raised edge against which may be supported a sheaf of papers, such as a speech, or the lower edge of book or binder to be supported during the course of a speech on the plate-like top surface 28.

The plate-like flat top surface 28 is also provided with a rear edge 37, which lies generally parallel to the top edge of the front panel 24 of the case top 6, and which is pivotally hinged to the front panel 24 by hinges 38 as illustrated best in FIG. 9. In the alternative, the rear edge 37 may utilize a so called "live" hinge 39 as illustrated in the embodiment of FIG. 12. This type of hinge constitutes an integral and flexible web extending between the rear edge 37 of the top plate 28 and the associated edge of the member 24. This type of a hinge arrangement is convenient when the parts are constructed integrally from an appropriate plastic material.

To support the lectern top 28 in elevated or extended position as illustrated in FIG. 1, there are pivotally attached to the side edge portions 29 and 31 of the top lectern portion 28 a pair of side support members 41 and 42, each having a top edge 43 abutting the underside of the top plate 28 and pivotally connected thereto by appropriate hinges 44. Each of the side support members preferably comprises a generally quadrilateral panel fabricated from wood, metal or appropriate plastic, with each of the side support members 41 and 42 being adapted to fold upwardly under the top plate 28 as illustrated best in FIG. 8.

It should be noted that the side support member 42 is adapted to fold next adjacent the underside of the top member 28, with the side support member 41 having a reinforced pad portion 46, and being adapted to pivot into a horizontal position under the top member 28 after the side support member 42 has been folded into position. This relationship of the parts is illustrated in cross-sectional view FIG. 11, which also shows the top plate portion 28 of the lectern folded downwardly on its hinge 38 so that the entire collapsible portion of the portable lectern assembly lies substantially within the confines of the top case portion 6. To lock the collapsed and folded lectern portions within the case 6, there is provided a latch 47 on back wall 19 of the top portion 6 of the case which may be pivoted into interlocking engagement with the front edge 32 of the top plate portion in the gap 36 that is formed in the lip portion 33 and 34 for this purpose. From the position of the parts illustrated in FIG. 11, it is obvious that the case may now be closed so that it assumes the appearance illustrated in FIG. 2.

Figure 6:
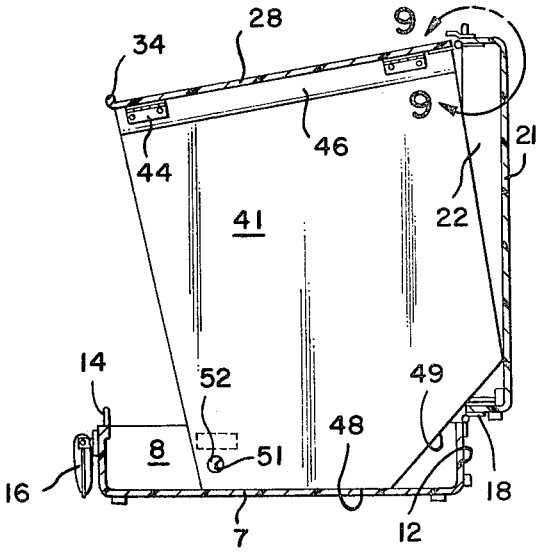
FIG. 6 is a vertical cross-sectional view taken in the plane indicated by the line 6—6 in FIG. 3.

To adequately support the lectern top plate portion 28, each of the side support members 41 and 42 are provided with a lower edge 48 that engages the inner surface of the bottom 7 of the lower portion 4 of the case. This relationship is shown best in FIGS. 1 and 6. As there shown, each of the side support members 41 and 42 is also provided with an angularly disposed rear edge portion 49 which, when the side support members 41 and 42 are in extended position as illustrated in FIGS. 1 and 6, abuts the associated edges of the back members 12 and 19 so as to provide additional stability to the structure. Additionally, to insure that the lectern does not inadvertently collapse during use, the lower end portions of the side support members 41 and 42 are detachably secured to the associated side members 8 and 9 of the lower case portion 4.

Figure 7:
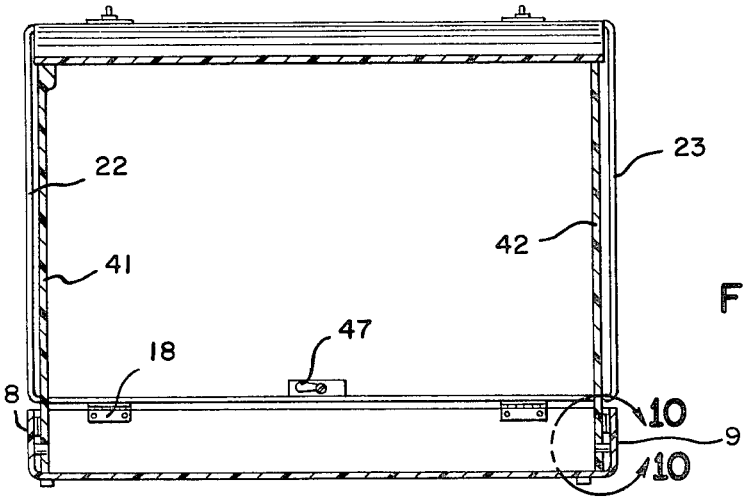
FIG. 7 is a vertical cross-sectional view taken in the plane indicated by the line 7—7 in FIG. 4.

As illustrated in FIGS. 6, 7 and 10, such detachable securement may take the form of an aperture 51 formed in each of the side support members 41 and 42 adapted to receive a lug 52 extending from each of the associated side walls 8 and 9, and in a position to engage the associated aperture 51 when the bottom edge 48 of the side support members 41 and 42 rest on the bottom 7 of the lower case portion 4. Engagement of the aperture 51 by the lug 52 prevents movement of the side support members 41 and 42 in an upward direction away from the bottom portion 4 of the case so that, if necessary, the entire assembly may be literally picked up from the top plate 28 and supported thereby when the apertures 51 are engaged by the associated lugs 52.

To prevent the side support members 41 and 42 from inadvertently moving inwardly into a collapsed condition as illustrated in FIG. 8, there is provided a pair of magnets 53 and 54 as illustrated best in FIG. 10, the magnet 53 being attached permanently to the side support member 42 while a magnetically responsive member 54 is attached securely to the inside surface of the side member 9. It will of course be obvious that an identical assembly is mounted on the side support member 41. With the parts engaged as in FIG. 10, the interengagement of the lug 52 with the aperture 51 prevents movement of the side support member 42 in its own plane, thus locking the top and bottom case portions in a predetermined open relationship, while the magnet assembly 53-54 prevents the inadvertent disengagement of the side support member 42 from the lug 52.

Figure 5:
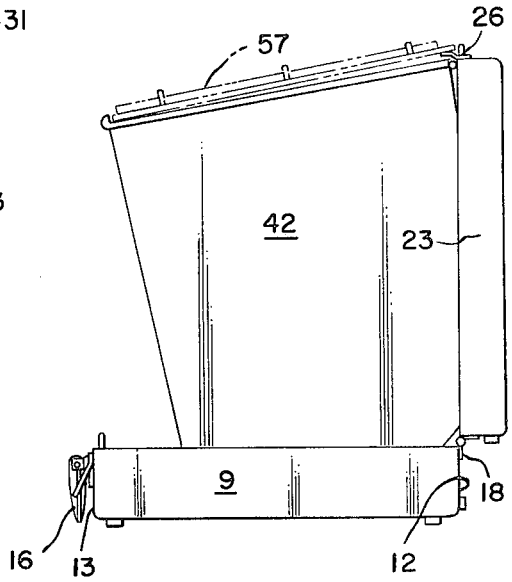
FIG. 5 is a right end elevational view of the portable lectern illustrated in FIG. 3.
Figure 4:
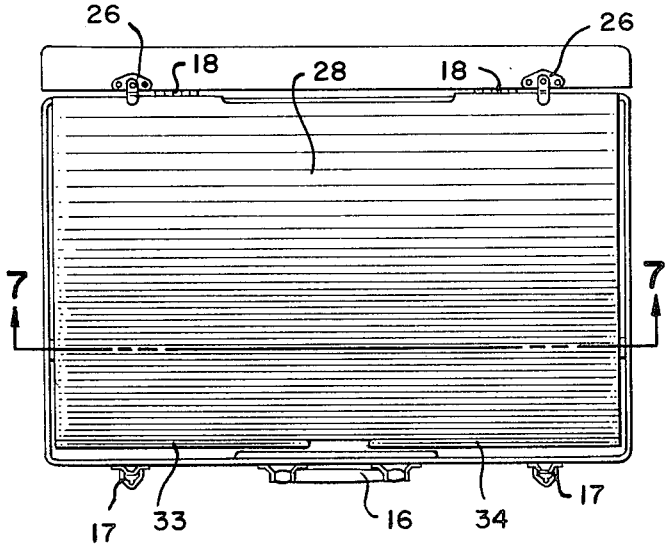
FIG. 4 is a top plan view of the portable lectern illustrated in FIG. 3.

In the embodiment of the invention illustrated in FIG. 13, it will be noticed that the bottom wall 7 of the lower case portion 4 is provided with a channel or indentation 56 dimensioned to frictionally accommodate the lower edge portion 48 of the associated side support member 41 or 42. In this embodiment of the invention, the channel or indentation 56 may be dimensioned so that insertion of the lower edge portion of the side support member 42 is accomplished by overcoming frictional resistance, thus providing a frictional force tending to prevent the inadvertent dislocation of the side support member 42. It should be noted that the height of the side support members 41 and 42 are chosen to provide a slight incline in the top member 28 of the lectern so as to more conveniently accommodate papers or books in a manner facilitating reading thereof. This is illustrated in FIG. 5, in which is illustrated in broken lines the binder 57, shown disposed on the top surface 28 and abutting the lips 33 and 34 at the forward edge of the lectern toop and overlying the latch member 26 at the upper end of the top plate portion 28. The binder is thus supported against inadvertent displacement.

I claim:

1. A lectern structure adapted for collapsibility to facilitate portability and for extension to constitute a lectern, comprising:

(a) a case including box-like top and bottom portions pivotally interconnected and pivotal from a case-closed condition to a case-open condition; and (b) a lectern assembly mounted within the case and including a top plate portion pivotally interconnected with the top of said case and side support members pivotally interconnected with said top plate portion, said side support members being pivotal from an extended position in which they engage the bottom case portion to a retracted position in which they lie substantially parallel to said top plate portion, said top plate portion being pivotal from a retracted position in which it lies substantially parallel to said top case portion to an extended position of use in which it lies substantially perpendicular to said top case portion.

2. The combination according to claim 1, in which said side support members lie substantially parallel to said top case portion when said top plate portion is in retracted position.

3. The combination according to claim 1, in which means are provided on said case for locking the case in closed condition.

4. The combination according to claim 1, in which means are provided on said top case portion for locking said top plate portion and side support members in retracted position within said top case portion.

5. The combination according to claim 1, in which means are provided on said lower case portion for locking said side support members in extended position.

6. The combination according to claim 1, in which means including said side support members are provided for locking the top and bottom case portions in a predetermined open relationship.

7. The combination according to claim 1, in which means are provided operatively interposed between said lower case portion and each said side support member resisting pivotal movement of said side support members in a direction to effect retraction thereof when they are in extended position.

8. The combination according to claim 5, in which said means includes an aperture in each side support member and an associated lug on the lower case portion interengageable with said aperture when each side support member is pivoted into extended position.

9. The combination according to claim 5, in which said means includes a magnet on each side support member and an operatively associated magnetically responsive member on said lower case portion interengageable with said magnet when each side support member is pivoted into extended position.

10. The combination according to claim 5, in which said means includes a recess in said lower case portion adapted to frictionally receive an edge portion of an associated side support member when said side support member is pivoted into extended position.

* * * * *